US011839263B2

(12) United States Patent
Steidle et al.

(10) Patent No.: US 11,839,263 B2
(45) Date of Patent: Dec. 12, 2023

(54) ADJUSTABLE FOOTWEAR FOR PLAYING FOOTBALL

(71) Applicant: Concave Global Pty. Ltd., Richmond (AU)

(72) Inventors: Volker Peter Steidle, Jakarta (ID); Andrew Neophitou, Melbourne (AU); Michael Petersen, Melbourne (AU); Andrew Theoklitos, Melbourne (AU)

(73) Assignee: Concave Global Pty. Ltd.

( * ) Notice: Subject to any disclaimer, the term of this patent is extended or adjusted under 35 U.S.C. 154(b) by 0 days.

(21) Appl. No.: 17/059,453

(22) PCT Filed: May 31, 2019

(86) PCT No.: PCT/AU2019/050568
§ 371 (c)(1),
(2) Date: Nov. 29, 2020

(87) PCT Pub. No.: WO2019/227178
PCT Pub. Date: Dec. 5, 2019

(65) Prior Publication Data

US 2021/0212408 A1 Jul. 15, 2021

(30) Foreign Application Priority Data

May 31, 2018 (AU) ..... 2018901947

(51) Int. Cl.
*A43B 5/02* (2006.01)
*A43B 3/26* (2006.01)
*A43B 23/02* (2006.01)

(52) U.S. Cl.
CPC ..... *A43B 3/26* (2013.01); *A43B 5/025* (2013.01); *A43B 23/027* (2013.01); *A43B 23/0275* (2013.01); *A43B 23/0285* (2013.01)

(58) Field of Classification Search
CPC ... A43B 23/26; A43B 23/027; A43B 23/0275; A43B 23/0285
(Continued)

(56) References Cited

U.S. PATENT DOCUMENTS 155,968 A 10/1874 Owens
2,661,547 A 12/1953 Hyde et al.
(Continued)

FOREIGN PATENT DOCUMENTS

AT 405004 B 4/1999
AT 307503 T 11/2005
(Continued)

OTHER PUBLICATIONS

PCT/AU2019/050568 International Search Report and Written Opinion dated Aug. 26, 2019 (17 p.).
(Continued)

*Primary Examiner* — Ted Kavanaugh
(74) *Attorney, Agent, or Firm* — Conley Rose, P.C.

(57) ABSTRACT

A football shoe or football boot includes a sole and an upper. The upper includes a central region and one or more protuberances at each side of the central region. The one or more protuberances on each side define a crest alongside the central region, such that the crests and the central region define a ball control region. The protuberances are formed by incorporation of fluid material with the upper, in direct contact with the upper.

16 Claims, 11 Drawing Sheets

(58) Field of Classification Search
USPC ..... 36/133
See application file for complete search history.

(56) References Cited

U.S. PATENT DOCUMENTS

| | | | | |
|---|---|---|---|---|
| 2,796,684 | A | 6/1957 | Montgomery | |
| 3,191,321 | A | 6/1965 | Bruetting | |
| 3,350,796 | A | 11/1967 | Bealle | |
| 3,525,165 | A | 8/1970 | Randall | |
| 3,703,775 | A | 11/1972 | Gatti | |
| 3,991,420 | A | 11/1976 | Savarino | |
| 4,065,861 | A | 1/1978 | Pelfrey | |
| 4,170,802 | A | 10/1979 | Roy | |
| 4,295,238 | A | 10/1981 | Clark | |
| 4,342,160 | A | 8/1982 | Clark | |
| 4,422,249 | A | 12/1983 | Hannah | |
| 4,447,967 | A | 5/1984 | Zaino | |
| D281,738 | S | 12/1985 | Gamm | |
| 4,617,746 | A | 10/1986 | Hannah | |
| D304,128 | S | 10/1989 | Kolman et al. | |
| 5,437,112 | A | 8/1995 | Johnston | |
| 5,647,150 | A | 7/1997 | Romanato et al. | |
| 5,701,688 | A | 12/1997 | Crowley | |
| 5,737,858 | A | 4/1998 | Levy | |
| 5,878,511 | A | 3/1999 | Krajcir | |
| 5,894,685 | A | 4/1999 | Yates | |
| D423,768 | S | 5/2000 | Hewett | |
| D427,423 | S | 7/2000 | Simpson | |
| D428,692 | S | 8/2000 | Haas-Chronis | |
| D432,771 | S | 10/2000 | Matis et al. | |
| D435,959 | S | 1/2001 | Akhidime | |
| 6,167,640 | B1 | 1/2001 | Schaefer | |
| D442,771 | S | 5/2001 | Haas | |
| D448,149 | S | 9/2001 | Matis et al. | |
| D450,180 | S | 11/2001 | Matis et al. | |
| 6,421,936 | B1 | 7/2002 | Gerrand | |
| 6,523,282 | B1 | 2/2003 | Johnston | |
| 6,631,569 | B1 | 10/2003 | Scharbius et al. | |
| 6,637,132 | B2 | 10/2003 | Gerrand | |
| D534,337 | S | 1/2007 | Gerrand | |
| 7,331,128 | B1 | 2/2008 | Navasky et al. | |
| 7,941,943 | B2 | 5/2011 | Baker et al. | |
| D644,018 | S | 8/2011 | Kass | |
| 8,196,320 | B2 | 6/2012 | Adami et al. | |
| 9,009,992 | B2 | 4/2015 | Baker et al. | |
| 10,674,784 | B2 | 6/2020 | Theoklitos et al. | |
| 2002/0029496 | A1 | 3/2002 | Morle et al. | |
| 2004/0055183 | A1* | 3/2004 | Lee | A43B 23/0235 36/133 |
| 2005/0144812 | A1 | 7/2005 | Wheeler | |
| 2007/0245596 | A1 | 10/2007 | Gerrand et al. | |
| 2009/0044427 | A1 | 2/2009 | Shepherd et al. | |
| 2009/0100711 | A1 | 4/2009 | Engel | |
| 2009/0100712 | A1 | 4/2009 | Baker et al. | |
| 2009/0113766 | A1 | 5/2009 | Hooper | |
| 2014/0137434 | A1 | 5/2014 | Craig | |
| 2016/0081419 | A1 | 3/2016 | Theoklitos et al. | |
| 2018/0035746 | A1 | 2/2018 | Steidle | |
| 2021/0204640 | A1* | 7/2021 | Oroszi | A43B 5/025 |

FOREIGN PATENT DOCUMENTS

| | | | | |
|---|---|---|---|---|
| AU | 346884 | S | | 2/2013 |
| CA | 2251139 | A1 | | 5/1999 |
| CN | 2065414 | U | | 11/1990 |
| CN | 2117048 | U | | 9/1992 |
| CN | 2371833 | Y | | 4/2000 |
| CN | 2392396 | Y | | 8/2000 |
| CN | 2577629 | Y | | 10/2003 |
| CN | 1158023 | C | | 7/2004 |
| CN | 105517458 | A | | 4/2016 |
| DE | 2827172 | A1 | | 1/1980 |
| DE | 8700439 | U1 | | 6/1987 |
| DE | 3831599 | A1 | | 3/1990 |
| DE | 3837504 | A1 | | 5/1990 |
| DE | 102016102792 | A1 | | 8/2017 |
| EP | 0496931 | A1 | | 8/1992 |
| EP | 0359082 | B1 | | 9/1993 |
| EP | 0359081 | B1 | | 11/1994 |
| EP | 0958753 | A2 | | 11/1999 |
| EP | 1430801 | A1 | | 6/2004 |
| EP | 3162239 | A1 | | 5/2017 |
| ES | 2086009 | T3 | | 6/1996 |
| FR | 1573835 | A | | 7/1969 |
| FR | 2293884 | A1 | | 7/1976 |
| FR | 3006151 | B1 | | 12/2015 |
| GB | 1193282 | A | | 5/1970 |
| GB | 1387268 | A | | 3/1975 |
| GB | 2060351 | A | | 5/1981 |
| IT | 238057 | Y1 | | 9/2000 |
| JP | H08332101 | A | * | 12/1996 |
| KR | 20110110499 | A | * | 12/1996 |
| KR | 1999-0037225 | U | | 10/1999 |
| KR | 100302253 | B1 | | 9/2001 |
| KR | 20070032569 | A | * | 3/2007 |
| KR | 20090042096 | A | | 4/2009 |
| KR | 100951111 | B1 | | 4/2010 |
| WO | 96/22712 | A1 | | 8/1996 |
| WO | 2014/183170 | A1 | | 11/2014 |
| WO | 2016/141427 | A1 | | 9/2016 |

OTHER PUBLICATIONS

Korean Office Action dated Feb. 24, 2021, for Korean Application No. 2017-544923 (5 p.).

Concave Football, "How to Lace Up Your Concave Boots," <http://www.youtube.com/watch?v=0kKdHyXlt10> [originally retrieved Jul. 7, 2014], Jan. 8, 2013, 21 pages of screenshots [retrieved Nov. 13, 2013].

International Search Report and Written Opinion dated Jul. 16, 2014, issued in corresponding International Application No. PCT/AU2014/050040, filed May 15, 2014, 10 pages.

European Supplementary Search Report dated May 3, 2022, for European Application No. 19811301 (8 p.).

Indian Examination Report dated Jun. 27, 2022, for Indian Application No. 202037056583 (8 p.).

* cited by examiner 22
24
20

10
20

ADJUSTABLE FOOTWEAR FOR PLAYING FOOTBALL

CROSS-REFERENCE TO RELATED APPLICATIONS

This application is a 35 U.S.C. § 371 national stage application of PCT/AU2019/050568 filed May 31, 2019, entitled "Adaptable Footwear for Playing Football," which claims priority to Australian Application No. 2018901947 filed May 31, 2018, and entitled "Adaptable Footwear for Playing Football," each of which is hereby incorporated herein by reference in its entirety for all purposes.

STATEMENT REGARDING FEDERALLY SPONSORED RESEARCH OR DEVELOPMENT

Not applicable.

FIELD OF THE INVENTION

This invention relates generally to footwear worn when playing football. The invention is suitable for all codes including soccer, rugby, and Australian, American, and Gaelic football but is especially useful when playing what is known in most countries as football and distinguished in others as soccer.

BACKGROUND OF THE INVENTION

There have been a number of proposals over time for football shoes or boots with uppers to enhance the outcome of kicking a ball. For example, U.S. Pat. No. 6,421,936 discloses a football shoe having an upper with an instep defined by a pair of longitudinally extending spaced-apart ridges laterally of a transversally concave surface for substantially cupping a ball that contacts the instep. The upper further has a toe region and the ridges have, at their front ends behind the toe region, front surfaces with respective upper peaks.

The broad concept of a concave ball contacting surface is also disclosed in European patent 359081, in which a pair of ridges are disposed along the sides of the lace region, and in European patent 496931 in which the concave surface extends from a planar shoe tip almost to the ankle opening. International patent publication WO1996/022712 describes a soccer shoe in which a mix of external leather patches and ribs in the toe region are thought to give the player a more accurate control of the ball during kicking.

With the configuration of U.S. Pat. No. 6,421,936, objective tests have established that the modified upper increases the departure velocity of the ball when all other factors are substantially equal, and subjective player experience is that the configuration increases kicking accuracy. Both these benefits are clearly valuable when kicking for goal in soccer and other football codes. However, player experience is that football shoes with modified uppers of the kinds disclosed in the aforementioned patents can be less comfortable than unmodified shoes, especially when running down the ground, because of reduced flexibility in the upper. This was a reason why the modified region is set back behind the toe region in embodiments described in U.S. Pat. No. 6,421,936, and in a commercial shoe made pursuant to that patent and marketed under the brand Concave®.

Another modified football shoe is disclosed in U.S. Pat. No. 7,941,943. This shoe includes a ball control insert containing one or more protruding ball control surfaces that are mounted within a flap portion which overlies the tongue. Whilst this modified shoe may enhance ball kicking ability, the location and extent of the ball control insert may be uncomfortable for the wearer, particularly when running.

To address the need to provide a more comfortable football shoe with enhanced ball kicking, the applicant developed a shoe, disclosed in International patent publication WO2014/183170, in which the generally rigid and concave, ball control region is located substantially rearwardly of the toe region within a flap that overlies the tongue. Due to its substantially rearward position, the rigid ball control region of this football shoe does not impose or impress upon the bridge or toes of the wearer's foot, thereby providing a more comfortable fit.

The applicant's international application WO2016/141427 discloses the concave ball region at the rear end of an insert with a long forward tail by which it is inserted into and fastened to the tongue of the shoe or boot.

While these shoes have been found beneficial for their improved kicking accuracy and ball speed, players have suggested that comfort might further be improved during running, and have also expressed some concern about the additional weight of the shoe arising from the inserted material to achieve the modified upper configuration. This is particularly the case with the insert of WO2014/183170 and WO2016/141427 where the unitary nature of the insert defining both ridges leads to added bulk.

Additionally, some wearers have experienced difficulty in lacing-up shoes which contain the modified upper configuration, or find such shoes to be aesthetically unappealing due to their bulkier size.

Another issue that arises, particularly for skilled wearers, is that some modified shoes or boots in the prior art result in the loss of 'ball feel', thereby nullifying some of the positive benefits that may be provided by the modified shoe or boot.

It is an object of the invention to at least in part address at least one of these concerns.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

SUMMARY OF THE INVENTION

Through trials and experimentation, the inventors of the present invention have realised that it is possible to address concerns about comfort, weight, ease of use, aesthetics, and most importantly ball feel, and still achieve enhanced ball kicking.

In accordance with a first aspect, the present invention provides a football shoe or football boot, including:

- a sole; and
- an upper including a throat region provided by flexible material of the upper, the throat region defining a boundary of the flexible material, with a canopy or tongue extending within the boundary;
- wherein the canopy or tongue includes a central portion and one or more protuberances disposed laterally of the central portion, the protuberances being formed of material added to material defining the canopy or tongue, wherein the central portion has either none or a negligible amount of the added material forming the protuberances.

The absence or negligible amount of added material enhances the ball feel within the central portion for the player. Any thin layer of added material that may be present in the central portion preferably has a negligible effect on hardness, rigidity or damping within the central portion.

In accordance with a second aspect, the present invention provides a football shoe or football boot, including:

a sole; and an upper including a throat region provided by flexible material of the upper, the throat region defining a boundary of the flexible material, with a canopy or tongue extending within the boundary;

wherein the canopy or tongue includes a central portion and one or more protuberances disposed laterally of the central portion, the central portion configured to provide a lower level of ball damping relative to the one or more protuberances.

The lower level of ball damping within the central portion enhances the ball feel for the player.

The throat region is that part of the upper, generally that part of the vamp which is generally rearward of the toebox and rearward of the throat line (if present) and forward of the wearer's ankle. Typically in sports shoes, this will include the fastening section and will include the eyestay (or "fastening receptors" as discussed below). The throat per se (where present) is an opening in the throat region and will typically be found where a tongue is provided. However, in the canopy version, the throat region may no longer provide an opening per se, if the canopy is attached along the boundary of the flexible material. The canopy need not be attached along the boundary although this is preferred to hold the canopy and the central portion in position during use. In one form of the invention, the canopy is of a different construction or material than substantially the remainder of the upper.

In another form of the invention, the canopy and substantially the remainder of the upper may be constructed from the same material such as an extensible material or fabric with the remainder of the upper clad or covered in a flexible material with lower extensibility than the canopy. For instance, the extensible material or fabric may be clad or covered in a sheath or film. The edge of the sheath or film suitably defines the boundary of the flexible material within which is provided the canopy is provided. The throat region may be distinguishable from the remainder of the upper or alternatively could be indistinguishable and simply define a particular region of the shoe or boot.

The boundary of the throat region may fully enclose the canopy or only partially surround the canopy. In another version of the invention, the boundary may border the canopy on two sides of the canopy.

In the tongue version, the tongue may be the same material as the remainder of the upper, or a material with similar properties as the remainder of the upper. Preferably the boundary partially surrounds the tongue e.g. on two sides of the tongue.

The central portion and the protuberances on both sides define a ball control region used to advantageous effect by the wearer. By having the central portion provide a reduced level of damping relative to the protuberances, advantageously the wearer is provided an improved degree of ball feel, which would otherwise be significantly dampened or nullified by having a material or structure, such as that material associated with or forming the protuberances, in that position. Further, by having the protuberances located on the canopy, wearers that, for example, have wider feet will continue to experience the ball kicking benefits provided by the protuberances as the protuberances will remain in a position that is centred relative to the wearer's foot. Thus, the beneficial effects provided by the protuberances pertaining to power and accuracy of ball kicking remains, whilst the wearer also experiences improved ball feel because of the reduced level of damping provided by the central portion.

The central portion may be less rigid than the one or more protuberances, thereby providing the reduced level of damping. The central portion may be of a lower hardness relative to the one or more protuberances, thereby providing the reduced level of damping.

The upper preferably comprises a flexible material for the wearer's optimum comfort. The flexible material is of a lower rigidity than the protuberances, and preferably is of a similar rigidity to the central portion. However, the flexible material may be more or less rigid than the central portion. In one preferred embodiment, the central portion may be defined by the absence of the material associated with or forming the protuberances. Where the central portion has an absence of the material associated with or forming the protuberances, the rigidity of the central portion will be that of the flexible material. Therefore, the material associated with or forming the protuberances may lie only laterally of the central portion. Thus, a wearer will have approximately the same level of 'ball feel' across the whole of the tongue or canopy, save for the regions containing the more rigid protuberances.

The protuberances may be formed by the application of a fluid such as settable plastics material to the tongue or canopy. Alternatively, the protuberances may be formed by the application of non-settable material to the tongue or canopy such as gel material. More particularly, the protuberances may be formed of an injectable material injected between inner and outer surfaces of the canopy or tongue. However, other methods of applying the settable plastics material are also known. The canopy or tongue may be formed of a first layer and a second layer, e.g. an outer layer and an inner layer, with the protuberances disposed between the first and second layers. For example, the protuberances may be formed of an injectable material injected between the first and second layers, e.g. the outer layer and the inner layer. The injected material may be in direct contact with the first and second layers. Alternatively, the protuberances may be pre-formed, for example inserts, which are then placed between the first and second layers e.g. the outer and inner layers. The protuberances may then be secured between the layers in any way known in the art. For example, the protuberances may be secured between the layers by adhesion, stitching, welding, or combinations of these securing techniques.

In one alternative, the protuberances may be disposed on an upper surface of the canopy or tongue. For example, the protuberances may be formed (e.g. by injection of a material) directly onto the upper surface of the canopy. In another example, the protuberances may be pre-formed, for example inserts, which are then secured to the upper surface. The pre-formed protuberances may be part of a separate element that overlies a region of the canopy or tongue.

In another alternative, the protuberances may be disposed on a lower surface of the canopy or tongue. For example, the protuberances may be formed (e.g. by injection of a material) directly onto the lower surface. In another example, the protuberances may be pre-formed, for example inserts, which are then secured to the lower surface. The pre-formed protuberances may be part of a separate element that underlies a region of the canopy or tongue. The separate element may be placed within a slit or slit defining a pocket in the canopy or tongue.

In another example, the protuberances may be integrally formed with the canopy or tongue, for example if the canopy or tongue is moulded or formed then the protuberances may be formed in that process such as by being overmoulded or undermoulded during the process.

The football shoe or football boot may comprise a fastening mechanism to fasten the shoe or boot in place and the fastening mechanism may be associated with a fastening region that contains, underlies, or overlies one or more components of the fastening mechanism. The canopy or tongue may be disposed at least in part within the fastening region.

The fastening mechanism preferably comprises a lacing system, but may also comprise any other known fastening means typical in the art such as those discussed below.

The protuberances may be of any suitable number, shape or size to achieve one or more of the desired effects. For example, there may be a single protuberance disposed at each side of the central portion. In another example, there may be a plurality of protuberances disposed at each side of the central portion. In yet another example, a different number of protuberances may be provided at each side of the central portion.

The protuberances preferably have rounded tops i.e. without a sharp apex. The protuberances may be arranged to define a crest on each side of the central portion. Each crest may be in the form of a single linear protuberance. The crests may be curved or straight. The crests may be evenly spaced apart along their lengths. Alternatively the crests may converge inwardly in the forward direction. This thereby defines a narrowing of the central portion from rear to front, whereby spacing between protuberances on opposite sides of the central portion is reduced. This extension of the protuberances may continue until the protuberances meet at a junction defining the forefront of the central portion. The inwardly converging protuberances can thereby provide the wearer a larger 'sweet spot' at which the wearer can cup the ball when kicking. The crests may be joined at their forward ends so that the two crests form a U shape. The crests may also converge inwardly at their reward ends but not to the same degree as at the forward end The height of the crests relative to the upper surface of the canopy or tongue may vary along their length. Preferably, the height tapers in the forward direction. Rather than joining and defining a U shape, the crests may taper in height and flatten into the upper surface of the tongue or canopy. This reduces the added material in the instep region and creates greater comfort for the wearer.

Additionally, the crests may taper in width in the forward direction.

Preferably, the forward (distal) portions are spaced from any elements of the fastening mechanism. This ensures that during ball kicking, the protuberances are able to provide the greatest possible benefit to the wearer, as interference between the fastening mechanism and the distal portions of the protuberances may diminish the full benefits provided by the protuberances. In one example, at least a portion of the protuberances are positioned rearward of the fastening region.

The fastening mechanism may be operatively engaged with the protuberances. For example, where lacing is employed, the laces may pass through the protuberances.

The canopy may extend rearwardly into a collar portion, which collar portion extends about an ankle or lower leg of a wearer when the shoe or boot is worn. The canopy may be relatively more extensible than the remainder of the upper to aid in insertion of the foot. The canopy may comprise elastomeric material such as neoprene or other stretch fabrics.

The canopy may be disposed in the fastening region in a manner that limits lateral and/or longitudinal movement relative to the remainder of the upper when the football boot or shoe is in an occupied configuration. For example, the canopy may be secured to the remainder of the upper, thereby limiting the lateral and/or longitudinal movement of the canopy relative to the upper. For example, the canopy may be secured by stitching, welding or glue to the upper. Alternatively, the canopy may be secured by the fastening means such as the lacing extending through the canopy. This helps to ensure that the protuberances and the central portion are always located in approximately the same position for the wearer. This is particularly beneficial because a conventional tongue of the football shoe or boot is prone to move during play, and having the protuberances and central portion in a predictable and consistent location means the wearer can utilise the benefits provided by these features with limited need for readjustment of the tongue.

In an alternative form of the invention, the remainder of the upper may have the same base material as the canopy as discussed above. Thus, the base layer forming the remainder of the upper and the canopy may be continuous.

The tongue may be attached to the upper or integral with the upper. The tongue may be secured by the fastening means such as the lacing extending through the side of the lateral sides. This helps to ensure that the protuberances and the central portion are always located in approximately the same position for the wearer.

The canopy may form a part of the upper, without a distinguishable tongue, as is known in conventional tongueless shoes. In another example, the canopy may form part of the upper, with the football shoe or boot further comprising a tongue disposed between the canopy and the wearer's foot. Having the tongue in addition to the canopy provides the wearer with the benefit associated with the canopy, i.e. the central portion and the protuberances, but also provides the wearer the benefits associated with a tongue. These benefits include ease of putting the shoe or boot on, taking the shoe or boot off, having elements of the fastening mechanism, such as laces, sit on the tongue rather than rub on the wearer's foot.

At least part of the central portion may lie within the fastening region. For example, the entire central portion may lie within the fastening region. Where the central portion lies partly within the fastening region, preferably it partly lies rearwardly of the fastening region. In an alternate example, the entire central portion may lie outside the fastening region. In this example, the central portion may lie rearward of the fastening region.

The central portion may be disposed over the instep of the wearer.

Any of the features described below in regard to other aspects of the invention, may also have application with these aspects of the invention.

In accordance with another aspect of the present invention, there is provided a football shoe or football boot, including:

a sole; and an upper, the upper including a central region, wherein the upper includes one or more protuberances at each side of the central region, the one or more protuberances on each side defining a crest alongside the central region, such that the crests and the central region define a ball control region, the protuberances having been formed by incorporation of fluid material with the upper, in direct contact with the upper.

In accordance with yet another aspect of the present invention, there is provided a method of forming a ball control region on an upper of a football shoe or football boot, the method including:

incorporating a fluid material with the upper in direct contact therewith to define one or more protuberances at each side of a central region, the one or more protuberances on each side arranged to define crest alongside the central region such that the crests and the central region define a ball control region on the shoe or boot.

The fluid material may be settable plastics material which once set forms the protuberances which may be more rigid or harder than the upper. Preferably, where the upper is formed of flexible material, the settable plastics material is applied directly to the flexible material of the upper, i.e. in direct contact with the flexible material of the upper. The settable plastics material may be applied after the upper has been made and before or after attachment to the sole. The settable plastics material may be in liquid form. The settable plastics material may be applied by injection either between layers in a multi-layered upper construction or an integral multi-layered flexible material such as leather; between the fibres or particles of the flexible material; within the interstices of the components of the flexible material; or on top of or underneath a single layer of flexible material. Where the settable plastics material is provided on one surface of the flexible material, it may adhere to that surface and form a protrusion in the other surface.

The protuberances may be disposed in any of the following positions: outboard of the fastening region, such as outboard of the lacing receptors e.g. lacing eyelets; distributed between the lacing receptors; on the tongue; or the canopy as defined above. The protuberances preferably lie within the throat region of the shoe. The protuberances preferably lie over the instep of the wearer. The final position of the protuberances may vary from the centre portion of the foot as a result of the varying foot shape of users Alternatively, the fluid material may be a fluid filler material. This may include gels, air, or metamaterials such as those that are malleable under normal pressure or manipulation and become firm on higher impacts. The fluid filler material may be applied after the upper has been made and before or after attachment to the sole. The fluid filler material may be in liquid form. The fluid filler material may be applied by injection either between layers in a multi-layered upper construction or an integral multi-layered flexible material such as leather; between the fibres of the flexible material; within the interstices of the components of the flexible material; or into a pocket within the upper.

As the crests are on each side of the central region, the application of the fluid material may be confined to discrete locations i.e. separated on either side of the central region with the absence or a negligible amount of settable plastics material within the central region.

Any of the features described in connection with other aspects of the invention, may also have application with these aspects of the invention.

In accordance with another aspect of the present invention, there is provided, a football shoe or football boot including:

a sole; and an upper defined by inner and outer surfaces, the upper having two spaced lateral crests with a region extending centrally between the two spaced lateral crests, the region being convex shaped at least in the occupied configuration of the shoe or boot, the crests resulting from material injected between the inner and outer surfaces of the upper.

In accordance with a still further aspect of the present invention, there is provided, a method of forming a ball control region on a football shoe or football boot including an upper defined by inner and outer surfaces, the method including:

injecting material between the inner and outer surfaces of the upper to form two spaced lateral crests, the crests disposed with a region extending centrally between the two spaced lateral crests being of convex shape, at least in the occupied configuration of the shoe or boot.

The material may be injected between first and second sheet layers of the upper. The convex region may include or be bordered by an opening. A placket may be formed at the edges of the opening and with the upper define inner and outer layers at the edges of the opening. Fluid material may be injected between the inner and outer layers, such as gel or settable plastics material. Where lacing or another fastening extends between the opening, the placket may also reinforce the edges.

Rather than having a multiple sheet layers defining the upper, there may be provided a leather upper or similar multi-layered sheet material, the crests resulting from material injected between the inner and outer layers.

For instance the multiple layers of the leather may comprise grain, corium and junction, with the crest material injected so as to separate two of the layers and form a pocket therein containing the injected material.

There may be more than one insert to define each crest. Preferably, the injected inserts are the only addition to the shoe to define the crest without the need for additional layers of material which would add to the weight and bulk of the shoe or boot.

Preferably the injected inserts are relatively more rigid or harder than the inner and/or outer layers.

Any of the features described above in connections with preceding or following aspects of the invention may have application to the fifth and sixth aspect of the invention.

In accordance with a further aspect, the present invention provides a football shoe or football boot, including:

a sole; and an upper including a throat region provided by flexible material of the upper, the throat region defining a boundary of the flexible material, with a canopy or tongue extending within the boundary;

wherein the canopy or tongue includes a central portion and one or more protuberances disposed laterally of the central portion, the protuberances having been formed by the application of fluid material to the canopy or tongue.

In accordance with a still further aspect, the present invention provides a method of forming a ball control region on an upper of a football shoe or football boot, the upper including a throat region provided by flexible material of the upper, the throat region defining a boundary of the flexible material, with a canopy or tongue extending within the boundary, the method including:

applying a fluid material to the canopy or tongue to define protuberances therein which define the ball control region.

The fluid material may comprise a settable plastics material. An additional step may comprise allowing the settable plastics material to set. Alternatively, the fluid material may comprise gel or other fluids as discussed above.

Any of the features described in connection with other aspects of the invention, may also have application with these aspects of the invention.

In accordance with a still further aspect of the present invention there is provided a football shoe or football boot including:

a sole; and an upper, the upper including a central region, wherein the upper includes one or more protuberances at each side of the central region, the one or more protuberances on each side defining a crest alongside the central region, the central region between the crests being of convex shape, such that in at least the occupied configuration of the shoe or boot, at least an apex of the central region is raised above the crests.

The central region may correspond to an instep region of the shoe or boot. By "instep region" is understood the part of a shoe or boot that fits over the upper surface of the arched middle portion of the human foot. The central region may include a fastening mechanism, to fasten the shoe or boot in place. The central region may be a fastening region.

The apex may be a single point or a ridge line down the centre of the central region between the adjacent crests on each side. At each point along the apex line, the apex point may be raised above the adjacent crest point. The convex shape of the central region may comprise a single convex mound between the crests.

At least an apex of the central region is raised above the crests in at least the occupied configuration of the shoe or boot. "Raised" is understood in the reference frame of the grounded configuration of the foot. As the fastening mechanism may take on various forms including a conventional lacing with a tongue therebeneath, the tongue may fall back in the unworn configuration. Thus, the "raised" feature is understood in the occupied configuration such as being worn or containing a shoe filler/stretcher or merely tissue paper as is commonly used in new shoes for display purposes. In shoes of more unconventional form such as shown in the present preferred embodiment of FIGS. 1 to 8, at least an apex of the central region is raised above the crests for both the worn and unworn configurations.

Preferably during some forms of ball contact with a standard round football or other kind of football, the convex shape alone is engageable, whereas during other forms of ball contact with said football, the convex shape and the crests are engageable with the football. For instance, during low power kicks, the football may only engage with the convex shape between the crests, to the exclusion to the crests. Other forms of ball contact may be high power kicks whereby the crests also make contact with the ball. During a high power kick, the deformation of the ball due to its resiliently deformable nature may be such that it wraps partially around the foot contacting the crests and the convex shape between the crests. The spacing between the crests may contribute to this functionality.

Each crest may be in the form of a single linear protuberance. The crests may also be curved or straight. The crests may be evenly spaced apart along their lengths. Alternatively, the crests may taper inwardly towards the front.

The protuberances may be formed by the application of settable plastics material to the upper. The protuberances defining the crests may be inserts disposed beneath an outer layer of the upper so that the upper has a seamless appearance. This may be achieved by injecting material beneath the outer layer of the upper. In a preferred form of the invention, the upper is defined by inner and outer surfaces or layers with material being injected between the inner and outer surfaces or layers.

For the embodiments of the invention described herein, preferably the injectable material is a settable plastics material. This material may adhere to one or both of the inner and outer layers. Thus, the injected material may be defined within a pocket between the inner and outer layers. This preferred process is called CPU-Fine Moulding, which is a compression moulding method (also referred to as "flow-moulding").

It is also possible to create the crests/protuberances through:

(i) as direct over-moulded on the external material
(ii) as an overlay
(iii) as a direct over-injection
(iv) under moulded
(v) sandwiching
(vi) injection moulding
(vii) under injection
(viii) drop in process of pre-moulded parts Preferably, the material defining the crests is more rigid than the layer(s) of the upper, as the case may be, depending on the particular mode of creation. The upper suitably comprises a flexible material for the wearer's optimum comfort whereas the protuberances are typically relatively more rigid thereby imparting a greater velocity and improved accuracy to a ball kicked as a result of contact with the protuberances/crests.

The preferred material for the crests/protuberances earlier described is a PU (Polyurethane) based material with Shore hardness 80-85A (the material hardness should cover the entire Shore A and Shore C and D range).

Any injectable and/or mouldable materials may be used—TPU's, TPR's, Rubber, Silicone, EVA, PET, PP, foams and all thermo and/or compression-mouldable materials and gels, liquids in any form, viscosity & shape including dual and/or multi density materials. Gel or fluid should fall within Shore 00 and Shore 000. Compressed gas could also be used to fill a pocket or cavity to create each crest/protuberance.

The shoe or boot of the embodiments herein described may also include an inner upper. Preferably the inner upper comprises flexible material for the wearer's optimum comfort. As such, the inner upper may be a soft flexible material such as a woven or knitted fabric or neoprene. Preferably, the inner upper is elastomeric, stretchable or extensible material which stretches to accommodate the user's foot when placed in the shoe. The inner upper may also incorporate a tongue and/or a collar around the heel. Thus, the inner upper, the tongue and the collar may be of unitary form which is secured to the sole plate. However, the invention according to the various aspects above also envisage a conventional tongue.

The convex shape between the crests may change during use of the shoe or boot. For example, the convex shape may present greatest convexity when the shoe is unworn. When the shoe is worn, depending upon the wearer's instep, the convex shape may present less convexity than in the unworn condition. However, some people's feet will create greater convexity in the central region during wearing. Thirdly, the convexity may also vary according to ball impact. For example, when the ball impacts the two spaced lateral crests, the ball may exert a spreading action on the two spaced lateral crests leading to lessening of the degree of convexity.

The central region between the crests may include a fastening mechanism which is preferably lacing but may also comprise any other known fastening typical in the art such as clasps such as hook and eye, clips such as snap fasteners, straps, bands that include velcro, or the like, or buckles, zips or toggles or the like. Where lacing is employed, the upper may have plural lacing receptors such as eyes or eyelets, apertures, loops, hooks or sleeves which are adapted to receive the lacing or similar fastener to fasten the shoe or boot in place. Typically the lacing receptors are arranged in laterally spaced sets. The lacing may extend between the sets e.g. with criss-cross or straight lacing.

The crests may lie outwardly of the fastening mechanism.

Any of the features described in connection with other aspects of the invention may have application to this aspect of the invention.

In accordance with yet another aspect of the present invention there is provided a football shoe or football boot including:

a sole; and an upper, the upper including a central laced region, wherein the upper includes one or more protuberances at each side, outside of the central laced region, the one or more protuberances on each side defining a crest alongside the central region.

Any of the features described above in connection with foregoing aspects of the invention may have application to this aspect of the invention.

In accordance with a further aspect, the present invention provides a football shoe or football boot, including:

a sole; and an upper including a throat region provided by flexible material of the upper, the throat region defining a boundary of the flexible material, with a canopy extending within the boundary;

wherein the canopy includes a central portion and one or more protuberances disposed laterally of the central portion, the one or more protuberances on each side defining a crest alongside the central portion such that the crests and the central portion define a ball control region and wherein the canopy includes extensible material such that the spacing between the crests is variable.

The spacing between the crests being variable enables the ball control region to adapt according to the shape of the inserted foot of the wearer. The wider the foot, the wider the crests/protuberances will be spaced or spread across the breadth of the foot.

Any of the features described above in connection with foregoing aspects of the invention may have application to this aspect of the invention.

It will be understood that the invention disclosed and defined in this specification extends to all alternative combinations of two or more of the individual features mentioned or evident from the text or drawings. All of these different combinations constitute various alternative aspects of the invention.

As used herein, except where the context requires otherwise, the term "comprise" and variations of the term, such as "comprising", "comprises" and "comprised", are not intended to exclude further additives, components, integers or steps.

Further aspects of the present invention and further embodiments of the aspects described in the preceding paragraphs will become apparent from the following description, given by way of example and with reference to the accompanying drawings.

BRIEF DESCRIPTION OF THE DRAWINGS

The invention will now be further described, by way of example only with reference to the accompanying figures in which.

DETAILED DESCRIPTION OF THE EMBODIMENTS

Figure 1A:
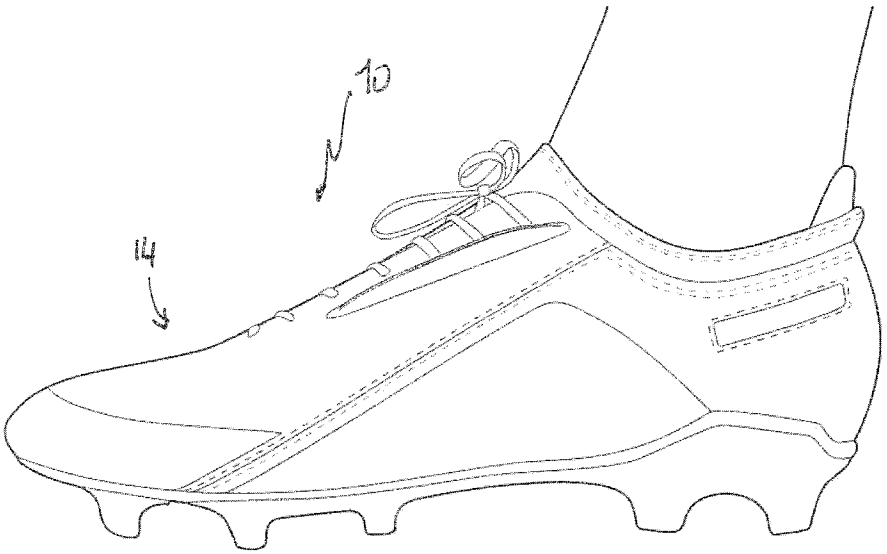
FIGS. 1A and 1B are side views showing the football boot or shoe according to a preferred embodiment of the present invention, with foot and without foot.

The illustrated embodiment of a football shoe 100 is designed especially for the form of football also known in some countries as soccer. In a first embodiment, the football shoe 10 includes a sole 12, and an upper 14. The upper 14 is comprised of an outer layer 16 and an inner upper 18 as can be best seen in FIG. 7. The outer layer 16 is fashioned in a suitable highly flexible leather or polymer material as is typical in the art. The outer layer 16 includes opposed lateral edges 20 which define a longitudinally extending lace-up opening 22 with lacing 24 extending between the opposing lateral edges 20 as is conventional. The opening may be bordered and reinforced by a placket 23 which extends, on each side, from the opening to a short distance beyond the associated crest 40 or crests when there are multiple crests on each side.

Figure 3A:
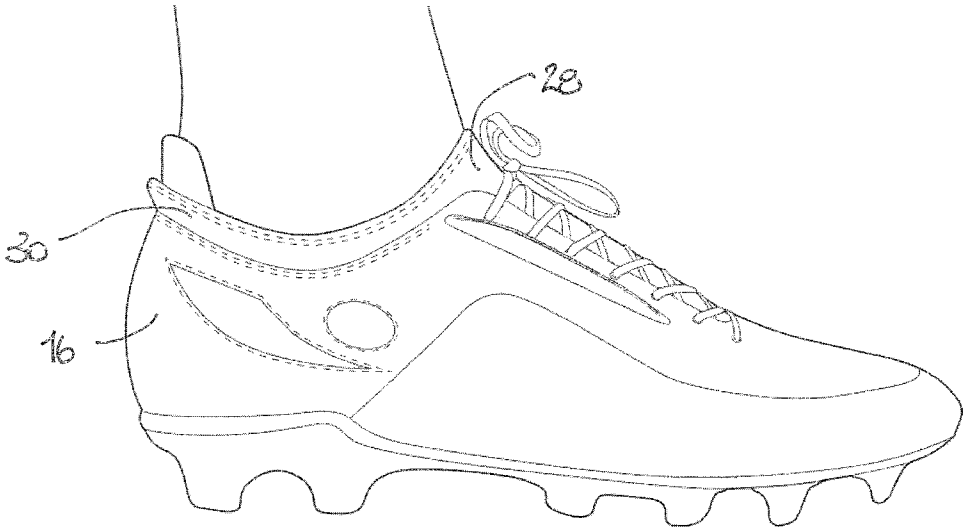
FIGS. 3A and 3B are the alternative side views of the preferred form of shoe with and without foot.
Figure 3B:
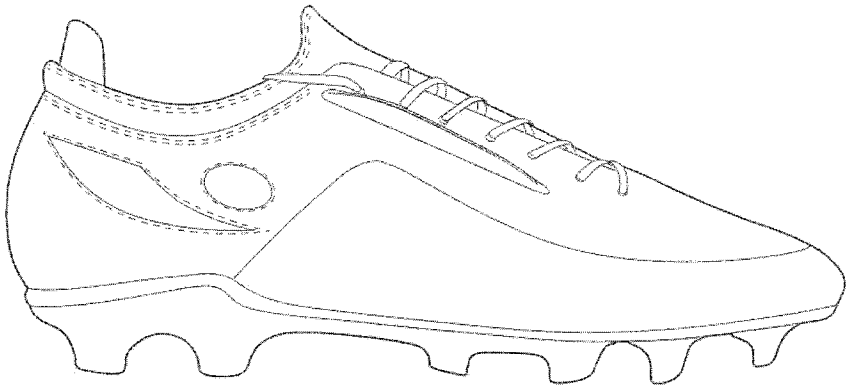
Figures 4A, 4B:
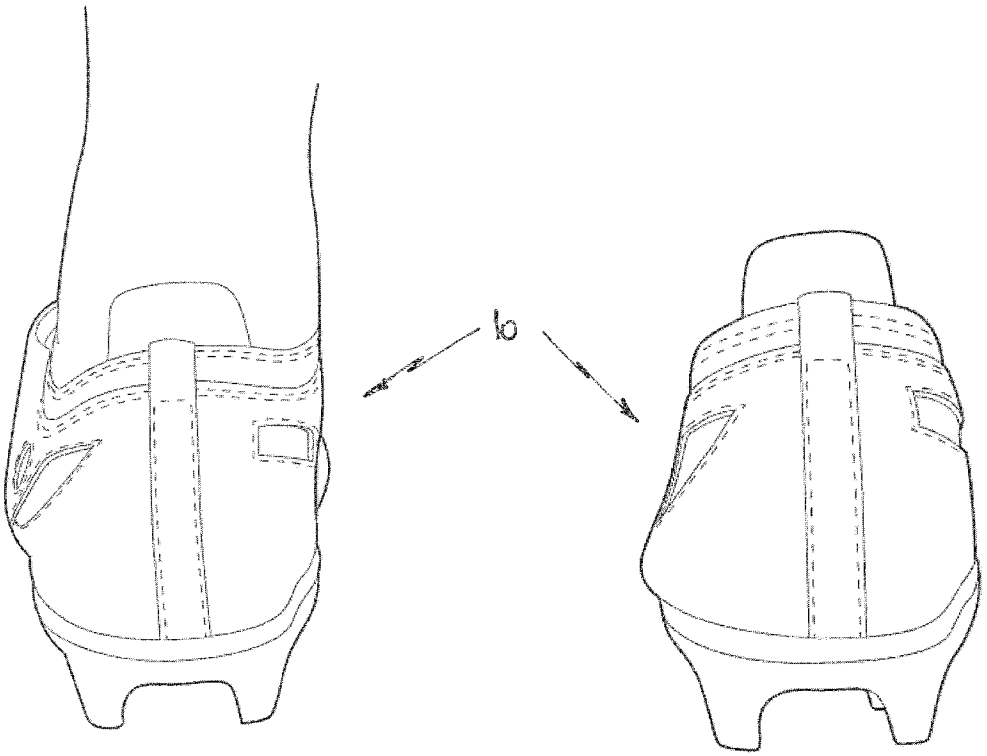
FIGS. 4A and 4B are rear views of the preferred form of the shoe with and without foot.
Figure 5B:
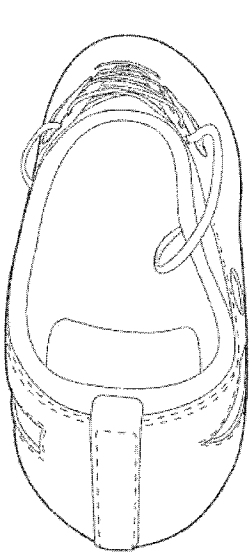
FIGS. 5A and 5B are 45 degree views from the rear of the preferred shoe, with and without foot.
Figure 5A:
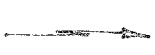
Figure 5A:
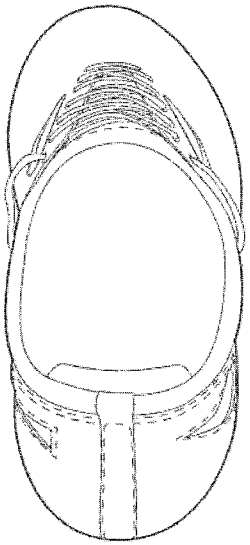

The inner upper 18 (see FIG. 7) is of neoprene material and defines a unitary overlay 26, tongue 28 and collar 30 (see FIG. 3). The neoprene is resiliently flexible to stretch when the user's foot is inserted into the shoe 10 to comfortably accommodate the user's foot. The neoprene also has a compressible, sponge-like quality providing an added layer of comfort for the user's foot. The inner upper 18 which defines the unitary overlay 26, tongue 28 and low profile collar (see FIG. 3) is received within the outer layer 16 but is exposed in the central lace-up opening 22, in the form of the tongue 28. Additionally, the low-profile collar 30 projects above the outer layer 16 around the whole of the ankle. The low-profile collar 30 is contiguous with the tongue 28 as can be seen from FIG. 3. The inner upper 18 may be stitched to the outer layer 16 around the collar 30.

As can be best seen from FIG. 7, the shoe 10 also includes crests 40 on either side of the central lace-up region. Each crest is formed from plastics material which is injected between the outer layer 16 and the placket 23 and then allowed to set to form relatively rigid crests.

The cross section of the inserts 42 may be substantially triangular. However, other forms are also included within the scope of the invention and a more preferred form is a rounded form as shown like a speed-hump. The cross sectional shape may be uniform along the length of the insert 42. However, it is possible that the insert may be of non-uniform cross section, for example, being progressively flatter in the forward direction. Thus, the insert 42 may taper in height, especially at each end. However, the form of an insert 42 is not limited to being lineal nor is it limited to being straight and curved crests are also possible. Furthermore, each crest 40 may not be defined by a single linear insert 42. Instead, the crest may be made up of a series of spaced protuberances.

While only one crest 40 is shown either side of the central lace-up region 22, there may be two or more substantially parallel extending rows of crests (not shown) on each side of the central lace-up region 22. The adjacent crests may vary in height, preferably diminishing in height, extending outwardly.

Figure 6B:
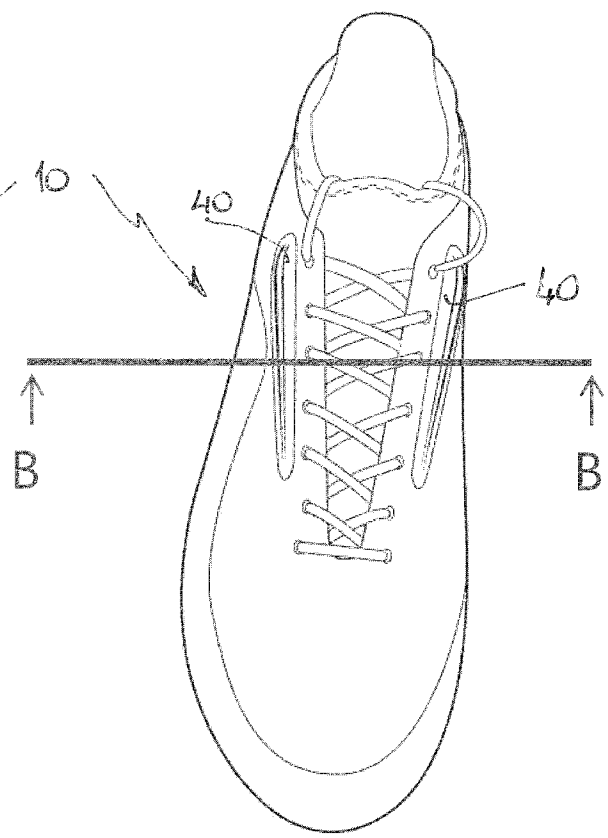
FIGS. 6A and 6B are plan views of the preferred form the shoe with and without foot.
Figure 6A:
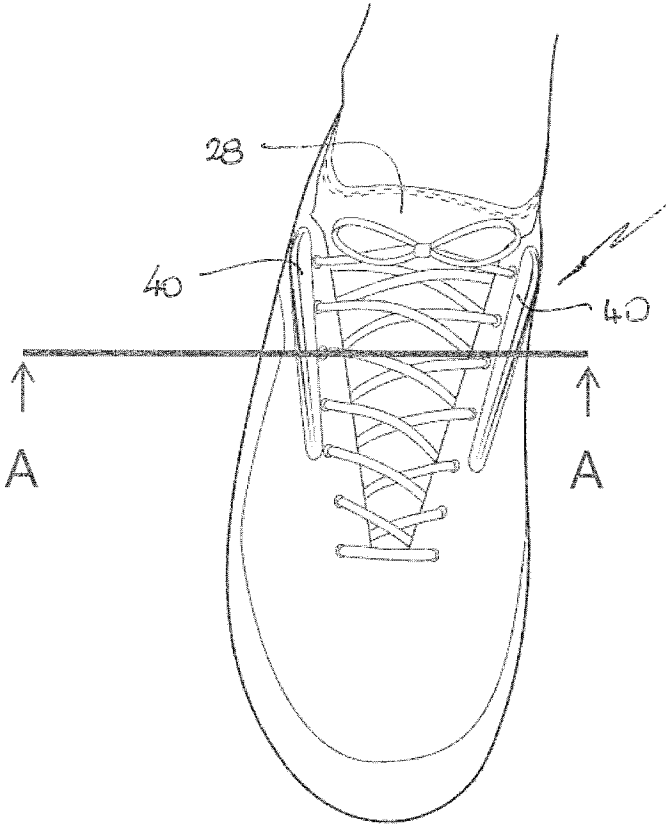

As best shown in FIG. 6, the two crests 40 may be arranged substantially parallel when the shoe is in the unworn configuration as shown in FIG. 6B. However, as shown in FIG. 6A, the stretch permitted by the elastomeric inner upper 18 enables a widening of the central lace-up region and a widening of the lace-up opening 22. This widening is not uniform over the length of the opening 22. Rather, there is a greater increase in the width of the gap towards the rearward direction. Accordingly, in the worn configuration, the crests 40 are splayed outwardly from front to back.

As is best seen from an understanding of FIG. 7, the benefits of the inserts 42 is three-fold. Firstly, the insert 42 is under the surface of the outer layer 16 and its presence will be less detectable and result in a more seamless appearance of the outer layer 16. Secondly, the existence of the insert 42 between the outer layer 16 and the strengthening placket 23 means that only one additional piece, that being the insert 42 itself is required to establish the presence of the crest 40. This reduces the need for additional pieces to hold the insert in place and therefore keeps the weight addition to a minimum. Thirdly, when the insert 42 is injected this will lead to manufacturing efficiency and also self-adhere the insert 42 into position.

The shoe 10 is made according to conventional shoe manufacturing techniques, except for the injected inserts 42. The inner and outer layers 18, 16 and placket 23 are die or laser cut according to a pattern from sheets of suitable material. The necessary stitching and gluing is then carried out including joining the placket 23 and the outer layer 16. The holes and any reinforcing required for the laces are then made through the outer layer 16 and the placket 23. The inserts 42 are injected between the outer layer 16 and the placket 23. The inner and outer layers 16, 18 of the upper may then be joined and the upper 14 is then moulded around the last and the sole plate is glued to the upper 14. While the crests 40 are injected, in accordance with some aspects of the invention, they could also be stitched on or inserted as preformed inserts into pockets. Rigid crests formed of expanded plastics material such as rigid foam are also possible. Such crests would be rigid but lightweight. Desirably, the crests are hard enough to have effect but not so hard as to be uncomfortable.

Figure 1B:
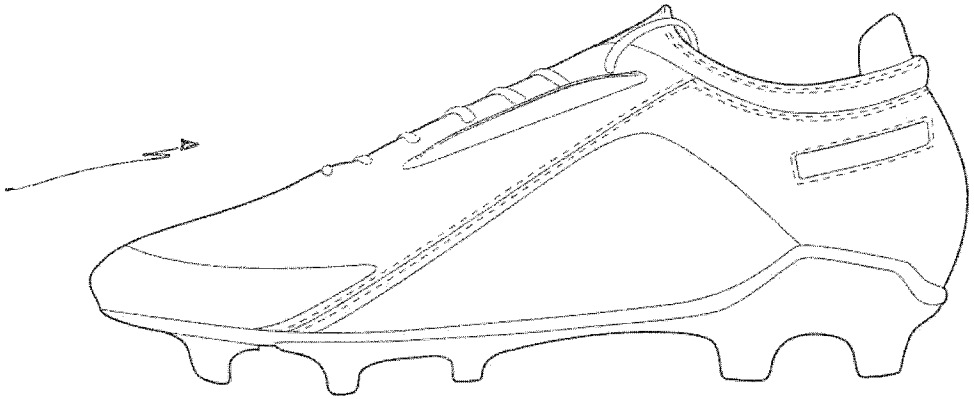
Figures 2A, 2B:
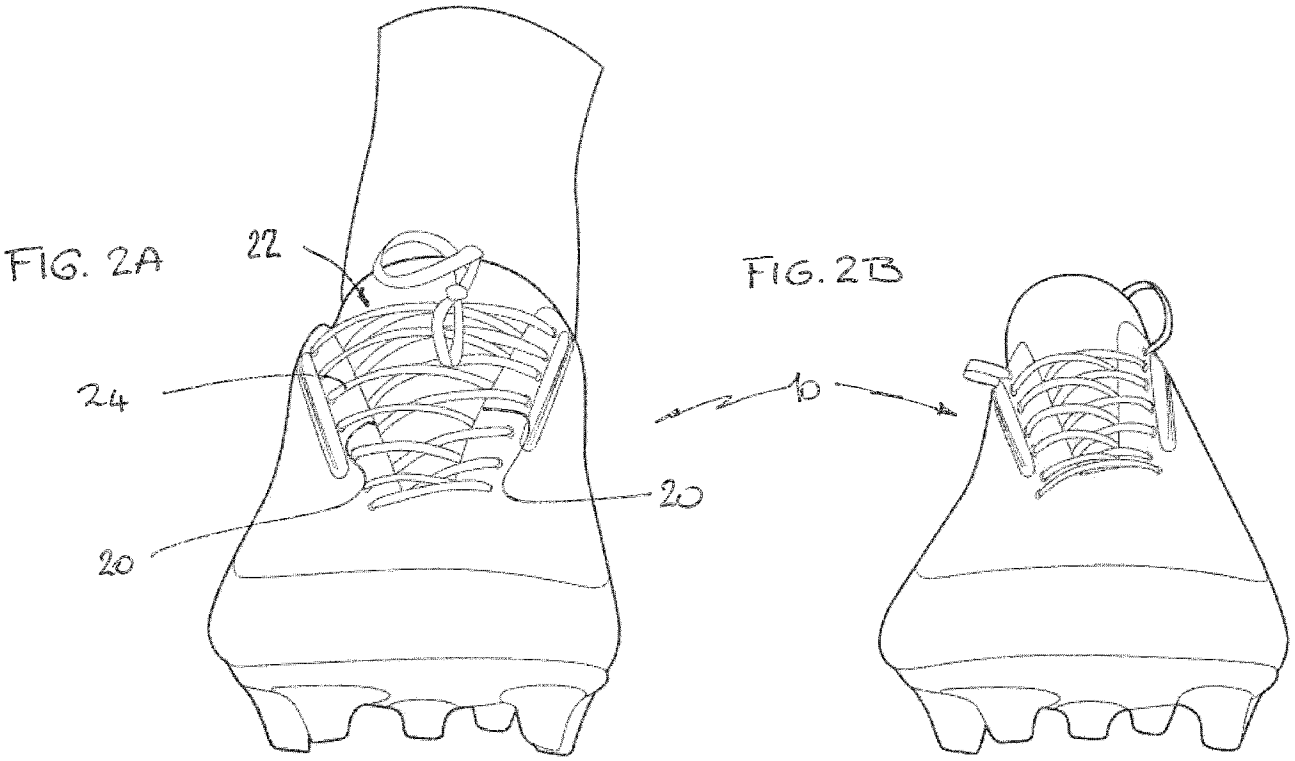
FIGS. 2A and 2B are front views of the preferred shoe with and without foot.
Figures 7A, 7B:
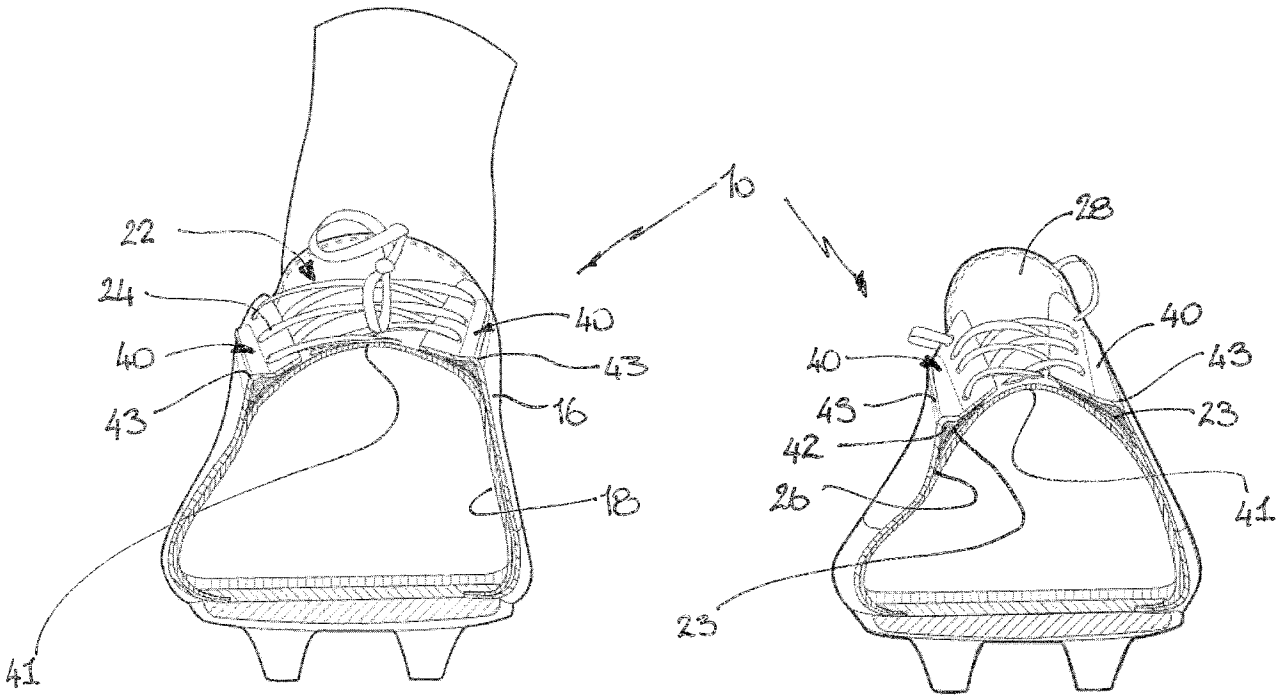
FIGS. 7A and 7B are transverse cross-sectional views of the preferred form of the shoe with and without foot.
Figure 8:
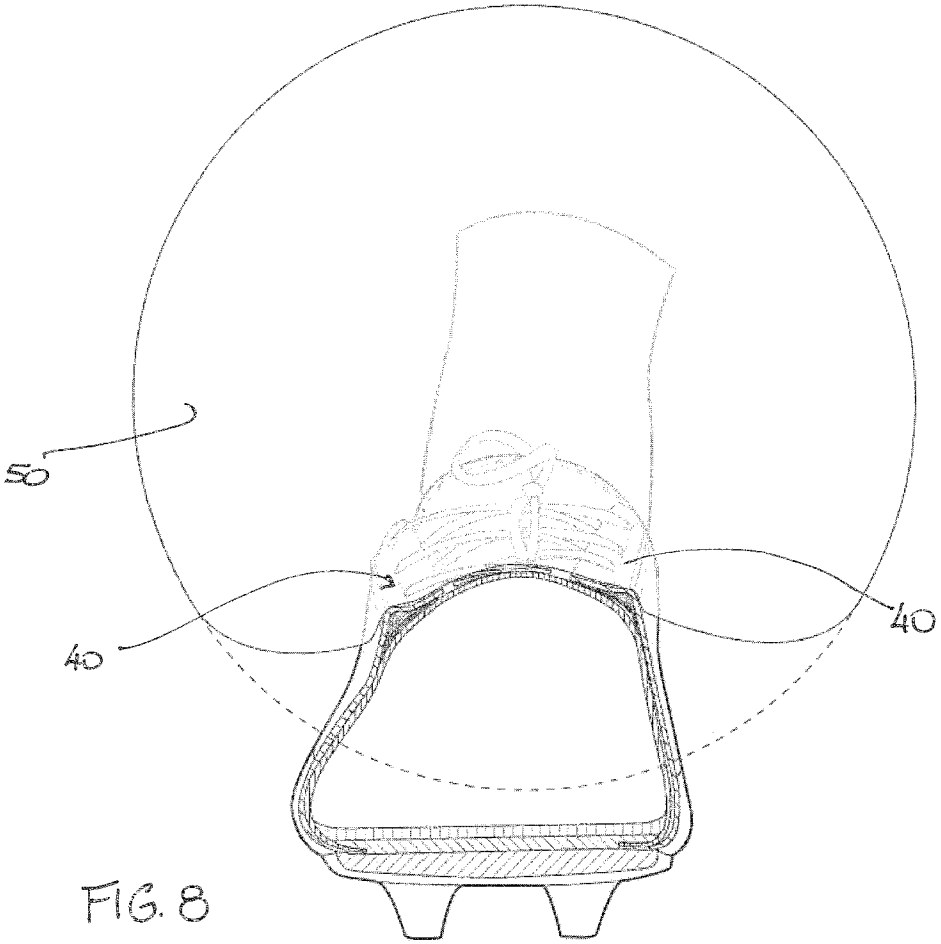
FIG. 8 is a transverse cross sectional view of the preferred form of the shoe, with foot, showing impact with a standard round football.

From a study of FIGS. 7 and 8, the change in form from the unworn configuration to the worn configuration and on impact with a ball 50 can be seen. As can be seen from FIG. 7B, the central region between the crests 40 is convex in transverse cross section in the unworn configuration and an apex 41 of the central region is raised above the corresponding adjacent crest points 43. FIG. 7B is mirrored in this respect. However, the dotted line indicates the location of the apex 41 and this will be understood from consideration of the side profile shown in FIG. 1B. This convexity may change when the user's foot is inserted into the shoe 10 as can be seen from FIG. 7A. As already explained in connection with FIG. 6, insertion of the user's foot will create a widening of the central lace-up region 22 with a more pronounced widening rearwardly of the shoe. Thus, as shown in FIG. 7A, the insertion of the user's foot brings about a decrease in the transverse convexity. However, this change in convexity may vary extending rearwardly of the shoe. The change in convexity may also be dependent upon the profile of the user's foot, particularly the instep area. With a high instep, the central region will present a relatively convex transverse profile compared to a user who has a flatter foot with a lower instep. In such a case, the transverse convexity will remain but it will not be as great.

It can be also seen in FIG. 7A that when the user's foot is inserted, the shoe upper 14 takes on a shape whereby it defines a top portion and two substantially upright side portions. In such a configuration, it can be seen that the crests 40 are disposed at the transition between the top portion and a respective side portion. This spacing of the crests 40 is important for reasons which will be discussed.

When the user strikes the ball 50 lightly, the impacts on the top of the user's foot in the central region (otherwise known as the "catchment area") will be unlikely to contact the crests 40, given the spacing of the crests and the convexity. Thus, for low power impacts, the ball will, to the extent that it impacts in the central region, will make contact with the convex surface wholly within the central region. However, on a relatively higher impact with the ball 50, the crests 40 will make contact with the ball as shown in FIG. 8. Thus, the relatively harder/more rigid nature of the crests 40 will impart greater velocity and/or accuracy to the rebounding ball 50. It can be also seen from study of FIG. 8 that the impact of the ball 50 may act to spread the crests 40 further apart, thereby leading to a further decrease in transverse convexity in the central region.

Figure 11:
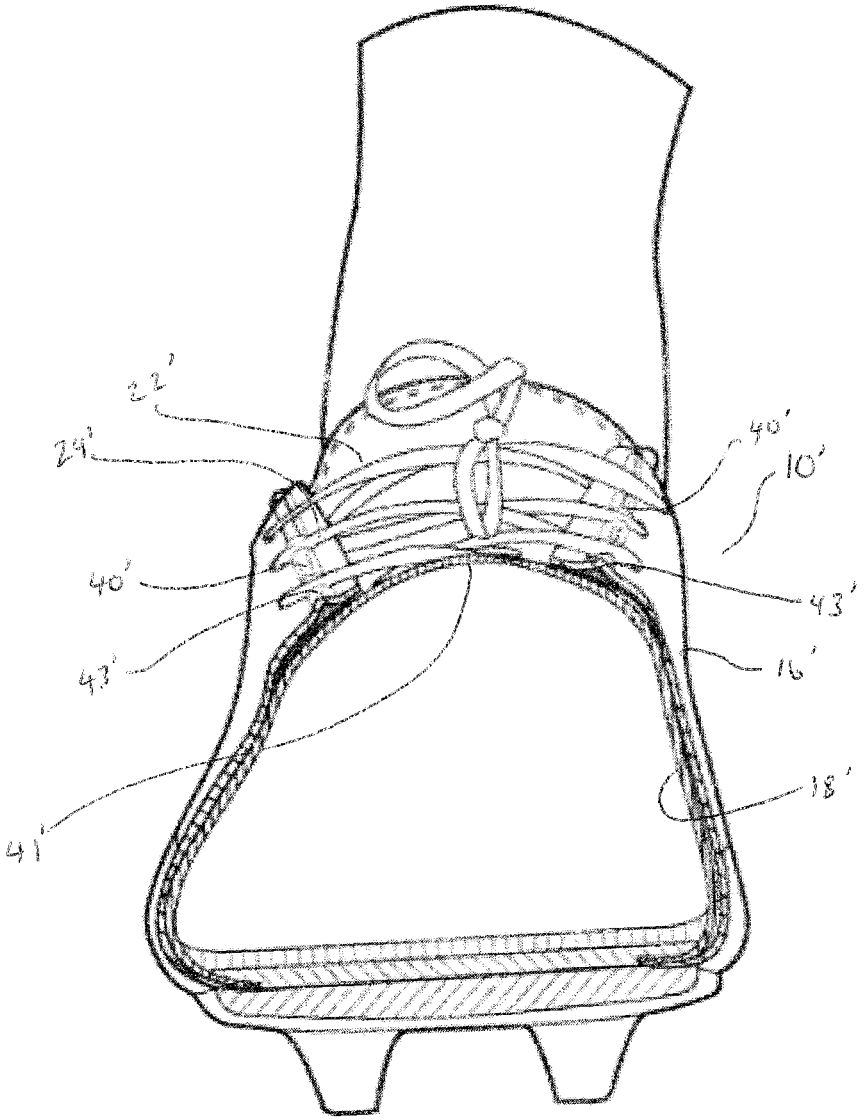
FIG. 11 is a transverse cross sectional view of a preferred form of the shoe, with foot.
Figure 12A:
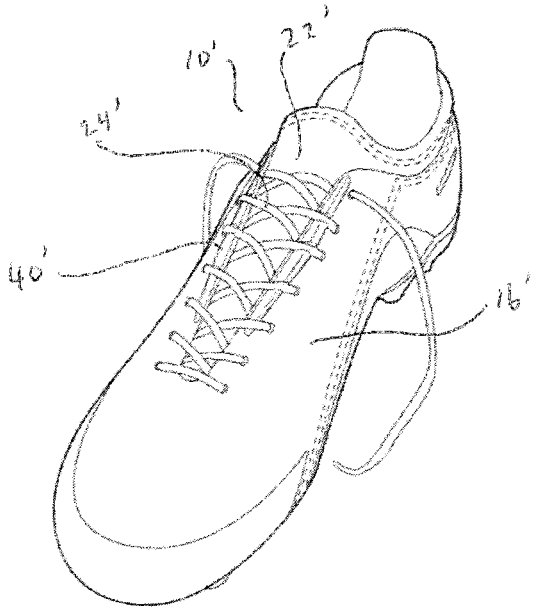
FIGS. 12A and 12B are perspective views of a shoe in accordance with another embodiment of the invention with and without a foot.
Figure 12B:
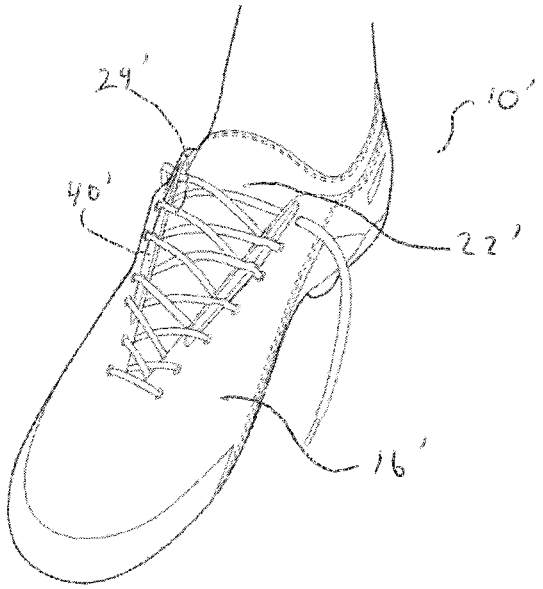
Figure 13:
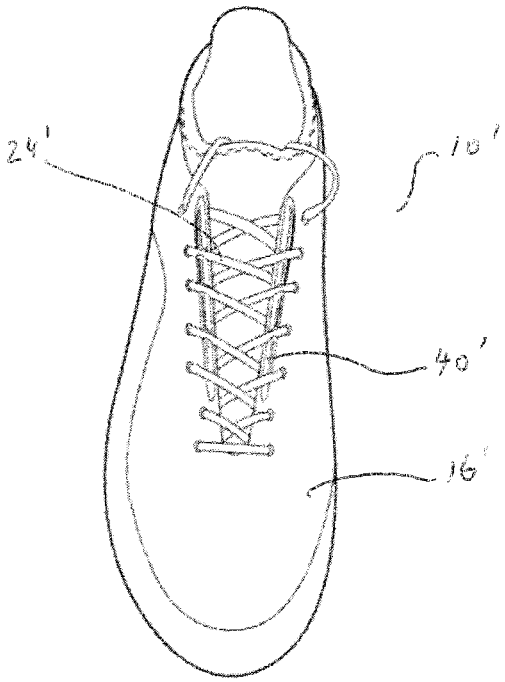
FIG. 13 is a front view of the shoe of FIGS. 12A and 12B.

FIGS. 11 to 13 illustrates an alternative embodiment of football shoe 10', wherein crests 40' are distributed between eyelets of the lacing and a boundary of central lace-up opening 22'. The crests 40' may include a plurality of spaced crests, or may be formed of a single crest, having slits therein to allow for the lacing to sit within. It will be appreciated from the earlier description that this embodiment includes many of the features earlier discussed as indicated by the repeated reference numerals.

Figure 9A:
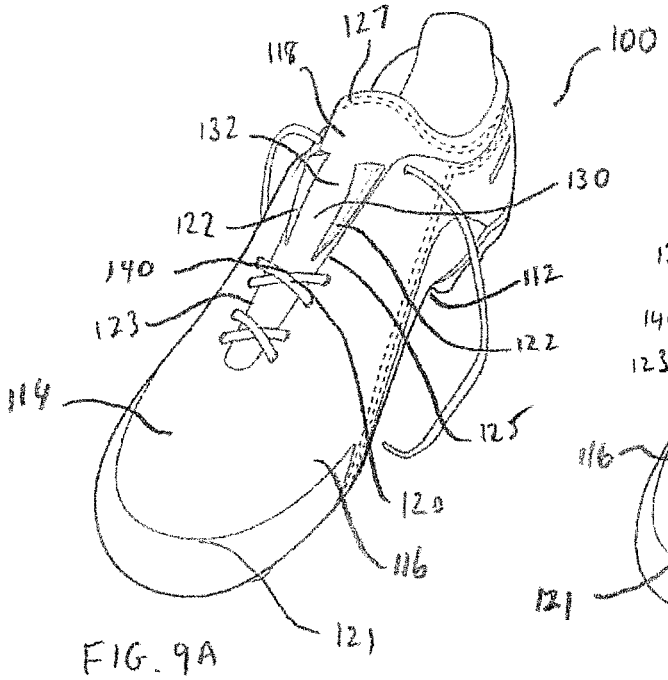
FIGS. 9A and 9B are perspective views of a shoe in accordance with another embodiment of the invention with and without a foot.
Figure 9B:
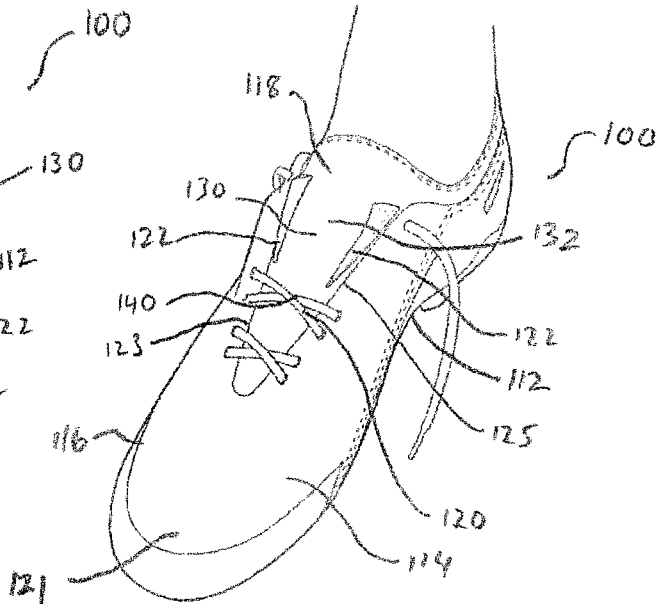

As shown in FIGS. 9A and 9B, the football shoe 100 includes a sole 112, and an upper 114. A fastening mechanism 120, in the form of a lacing mechanism as known in the art, is provided in order for a wearer to secure the football shoe 100 to their foot. The upper 112 includes a canopy 130, defined somewhat by its position relative to a fastening region 140 that is associated with the fastening mechanism 120 and a lower upper 116. The fastening region is to be understood as defining a region of the upper that contains, underlies, or overlies one or more components of the fastening mechanism 120.

Otherwise, the canopy can be defined by reference to a throat region 125 which is part of the vamp (generally unified with the quarter in a sports shoe) behind the toe box or toe cap 121 and generally over the instep of the wearer. The throat region defines a boundary 123 of the flexible material of the lower upper 116. The canopy 130 and the lower upper 116 can be secured together in any suitable manner known in the art, including stitching and welding.

The canopy extends to form a collar portion 127 around the wearer's ankle.

Figure 10:
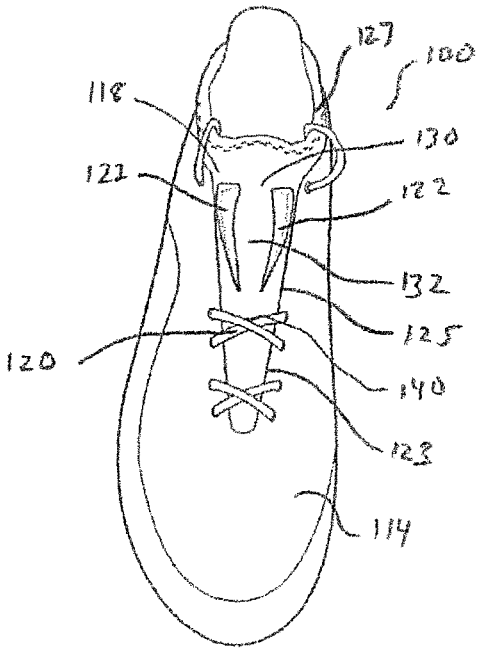
FIG. 10 is a front view of the shoe of FIGS. 9A and 9B.

As will be appreciated from FIGS. 9A, 9B and 10, part of the fastening mechanism 120, in this case a foremost portion and a rearward portion of the fastening mechanism 120, has laces that are visible from the outside of the football shoe 100. Conversely, the portion between the foremost portion and the rearward portion, has laces that are not visible from the outside of the football shoe 100. The laces that are not visible lay beneath the canopy 130.

The canopy 130 is comprised of a first material that includes an outer surface 118 and an inner surface (not shown). As best seen in FIG. 10, the canopy 130 includes a central portion 132 comprised primarily of the first material, and protuberances 122 formed between the outer surface 118 and the inner surface of the canopy 130 laterally of the central portion 132. The protuberances are formed of a second material that is of greater rigidity and/or hardness than the first material. The provision of protuberances 122 at canopy 130 define a ball control region which provides the wearer the ability to kick a ball with greater power and accuracy when the protuberances contact a football in the act of kicking. Further, the provision of the relatively less rigid central portion 132 will also provide the wearer improved ball feel when kicking the ball, as the wearer will not experience the same level of dampened ball feel that would otherwise be experienced by having a more rigid material in the central portion 132.

In the embodiment of FIGS. 9A, 9B and 10, the protuberances 122 are in the form of upwardly extending crests 124. The crests 122 extend linearly from a relatively rearward section of the fastening region 140 towards a forward section of the fastening region 140 in an inwardly converging fashion, thereby forming a substantially V-shaped protuberance with a junction 134 at which the crests may join. In this form, the protuberances 122 allow a wearer to cup the ball when kicking, thereby providing a 'sweet spot' without the addition of material at the central portion, leading to improved ball feel and less additional weight. Whilst the figures depict two protuberances, one on each side of the central portion 132, there may be any number of protuberances on either side of the central portion. The protuberances may be of any size and shape, and in some embodiments may be formed between portions of the fastening mechanism 120.

It is preferred that protuberances 122, in particular crests 124, do not directly contact any components of the fastening mechanism 120. This ensures that the fastening mechanism does not interfere with protuberances 122 and thereby limit any of the kicking benefits provided by the protuberances 122. In this embodiment, the protuberances 122 are formed by injecting a suitable fluid material between the outer surface 118 and the inner surface. The material when set will be of greater rigidity than the first material of the canopy 130. In other embodiments, the protuberances 122 can be formed on an upper surface of canopy 130. In yet another embodiment, the protuberances 122 can be formed on the underside of canopy 130.

Football shoe 100 may include a tongue (not shown) underlying the canopy 130. In such an embodiment, the tongue provides a layer of material between the wearer's foot or sock, and the fastening mechanism 120. This ensures that, in this case, the lacing does not sit on top of the wearer's foot or sock and cause discomfort.

In an alternative embodiment, rather than having canopy 130, the football shoe 100 may include a conventional tongue as is known in the art. In such an embodiment, the protuberances are disposed on the tongue. For example, the protuberances may be disposed between an inner and outer surface of the tongue, on an underside surface of the tongue, or on an upper surface of the tongue.

The foregoing defines only some embodiments of the present invention and modifications may be made thereto without departing from the scope of the invention.

The invention claimed is:

1. A football shoe or football boot including:

a sole; and an upper, the upper including a ball control region including a central region and one or more protuberances at each side of the central region, the one or more protuberances on each side defining a single crest along each side of the central region, the crests arranged substantially parallel or arranged to converge inwardly towards a forward direction of the football shoe or boot in at least the unoccupied configuration of the shoe or boot, said crests arranged substantially symmetrically about the central region, the central region between the crests being of convex shape, such that in at least the occupied configuration of the shoe or boot, at least an apex of the central region is raised above the crests, wherein the upper includes a throat region provided by flexible material of the upper, said throat region being that part of the upper that is generally rearward of a toebox and rearward of a throat line and forward of a wearer's ankle, and wherein the crests at each side of the central region lie within the throat region, and wherein the central region and the crests of the ball control region are contactable with a ball when the shoe or boot is worn by the wearer.

2. The football shoe or football boot as claimed in claim 1 wherein the material defining the crests is more rigid or harder than the upper.

3. The football shoe or football boot as claimed in claim 1 wherein the shoe or boot also includes an inner upper of flexible material which is relatively softer than an outer upper.

4. The football shoe or football boot as claimed in claim 1 wherein the central region between the crests includes a fastening mechanism and the crests lie outwardly of the fastening mechanism.

5. The football shoe or football boot as claimed in claim 4, wherein the inner upper is elastomeric, stretchable or extensible material, which stretches to accommodate a user's foot when places in the shoe.

6. The football shoe or football boot as claimed in claim 5, wherein the inner upper is extensible material such that the spacing between the crests is variable.

7. The football shoe or football boot as claimed in claim 6, wherein the inner upper incorporates a tongue and/or collar around the heel.

8. The football shoe or football boot as claimed in claim 1, wherein the flexible material is of a lower rigidity than the protuberances.

9. The football shoe or football boot as claimed in claim 1, the central region is defined by the absence of a material associated with or forming the protuberances.

10. The football shoe or football boot as claimed in claim 9, wherein the material associated with or forming the protuberances lies only laterally of the central region.

11. The football shoe or football boot as claimed in claim 1, wherein in the occupied configuration the upper takes on a shape whereby it defines a top portion and two substantially upright side portions, wherein the crests are disposed at the transition between the top portion and a respective side portion.

12. The football shoe or football boot as claimed in claim 1, wherein the ball control region includes a single linear protuberance at each side of the central region, said single linear protuberance defining said single crest.

13. The football shoe or football boot as claimed in claim 1, wherein the central region corresponds to an instep region of the shoe or boot.

14. The football shoe or football boot as claimed in claim 1, wherein the apex is a single point or a ridge line down the centre of the central region between the adjacent crests on each side.

15. The football shoe or football boot as claimed in claim 14, wherein the apex is the ridge line, wherein at each point along the ridge line, the apex point is raised above the adjacent crest point.

16. The football shoe or football boot as claimed in claim 1 wherein the crests at each side of the central region each extend longitudinally between the toebox and the wearer's ankle when the shoe or boot is worn by the wearer.

* * * * *